US005457000A

United States Patent [19]

Defieuw et al.

[11] Patent Number: 5,457,000

[45] Date of Patent: Oct. 10, 1995

[54] DYE-IMAGE RECEIVING ELEMENT FOR USE ACCORDING TO THERMAL DYE SUBLIMATION TRANSFER

[75] Inventors: Geert H. Defieuw, Kessel-Lo; Herman J. Uytterhoeven, Bonheiden, both of Belgium; Rolf Wehrmann; Wolfgang Ebert, both of Krefeld, Germany

[73] Assignee: Agfa-Gevaert, N.V., Mortsel, Belgium

[21] Appl. No.: 219,419

[22] Filed: Mar. 29, 1994

Related U.S. Application Data

[63] Continuation of Ser. No. 928,736, Aug. 13, 1992, abandoned.

[30] Foreign Application Priority Data

Sep. 10, 1991 [EP] European Pat. Off. ..... 91202307

[51] Int. Cl.[6] ..... B41M 5/035

[52] U.S. Cl. ..... 430/200; 430/201; 503/227

[58] Field of Search ..... 503/227; 430/201, 430/200; 558/273, 274, 270; 524/280, 281

[56] References Cited

U.S. PATENT DOCUMENTS

| | | | |
|---|---|---|---|
| 2,189,205 | 2/1940 | Grether et al. | 558/273 |
| 3,148,203 | 9/1964 | Schisla et al. | 524/281 |
| 3,269,971 | 8/1966 | Goldblum | 524/280 |
| 4,871,715 | 10/1989 | Harrison et al. | 503/227 |
| 4,876,236 | 10/1989 | Vanier et al. | 503/227 |
| 4,985,395 | 1/1991 | Vanmaele et al. | 503/227 |
| 5,026,677 | 6/1991 | Vanmaele | 503/227 |
| 5,157,013 | 10/1992 | Sakai | 503/227 |

*Primary Examiner*—Charles L. Bowers, Jr.
*Assistant Examiner*—Martin J. Angebranndt
*Attorney, Agent, or Firm*—Breiner & Breiner

[57] ABSTRACT

Dye-image receiving element for use according to thermal dye sublimation transfer comprising a support having thereon a dye-image receiving layer comprising a plasticizer, characterized in that the plasticizer is a di(hetero)aryl carbonate having not more than four recurring units between the two (hetero)aryl moieties.

5 Claims, No Drawings

DYE-IMAGE RECEIVING ELEMENT FOR USE ACCORDING TO THERMAL DYE SUBLIMATION TRANSFER

This is a continuation of application Ser. No. 07/928,736 filed on Aug. 13, 1992, now abandoned.

DESCRIPTION

1. Field of the invention.

The present invention relates to dye-image receiving elements for use according to thermal dye sublimation transfer and in particular to a plasticizer for use in said dye-image receiving element.

2. Background of the invention.

Thermal dye sublimation transfer also called thermal dye diffusion transfer is a recording method in which a dye-donor element provided with a dye layer containing sublimable dyes having heat transferability is brought into contact with a dye-image receiving element and selectively, in accordance with a pattern information signal, heated with a thermal printing head provided with a plurality of juxtaposed heat-generating resistors, whereby dye from the selectively heated regions of the dye-donor element is transferred to the dye-image receiving element and forms a pattern thereon, the shape and density of which is in accordance with the pattern and intensity of heat applied to the dye-donor element.

A dye-image receiving element for use according to thermal dye sublimation transfer usually comprises a support, e.g. paper or a transparant film, coated with a dye-image receiving layer, into which the dye can diffuse more readily. An adhesive layer may be provided between the support and the receiving layer. On top of said receiving layer a separate release layer may be provided to improve the releasability of the receiving element from the donor element after transfer is effected.

As resins constituting the dye-image receiving layer there are known various thermoplastic resins such as polycarbonates, polyurethanes, polyesters, polyamides, polyvinylchlorides, poly(styrene-co-acrylonitriles), polycaprolactones or mixtures thereof and various cross-linked heat-cured or radiation-cured resins.

It has been known to incorporate a plasticizer in the dye-image receiving layer in order to increase the dye density of the transferred image. Various types of plasticizers have been described for that purpose; see, for example, U.S. Pat. No. 4871715, JP 61/268483, JP 61/274990, JP 62/132676 and JP 02/194995. Frequently used plasticizers are phthalate esters such as described in U.S. Pat. No. 4,871,715. However using said plasticizers in the dye-image receiving layer leads to a decrease in sharpness of the obtained transferred dye image.

SUMMARY OF THE INVENTION

It is an object of the present invention to provide a plasticizer for use in the dye-image receiving element not having the disadvantages mentioned above.

The present invention provides a dye-image receiving element for use according to thermal dye sublimation transfer comprising a support having thereon a dye-image receiving layer comprising a plasticizer, characterized in that the plasticizer is a di(hetero)aryl carbonate having not more than four recurring units between the two (hetero)aryl moieties.

By (hetero)aryl is meant aryl or heteroaryl.

Using plasticizers according to the present invention in the dye-image receiving layer yield increased dye transfer densities without loss of sharpness (or less loss than with the conventional plasticizers) and without loss of surface gloss. Further the coating shows less surface cracking after drying.

DETAILED DESCRIPTION OF THE INVENTION

Plasticizers according to the present invention are di(hetero)aryl carbonates wherein the (hetero)aryl group is selected from the group consisting of phenyl, naphthyl, thiophene and pyridine. The two (hetero)aryl groups may be the same or may be different. Further the (hetero)aryl groups may be substituted or not-substituted. Substituents on the (hetero)aryl groups include alkyl groups, cycloalkyl groups, aralkyl groups, aryl groups, alkoxy groups, aryloxy groups, acyl groups, ester groups, amide groups, amine groups, ether groups, carbonate groups, which groups may be substituted, halogen atoms, hydroxy groups, nitrile groups.

According to a preferred embodiment of the present invention the di(hetero)aryl carbonate corresponds to the following formula

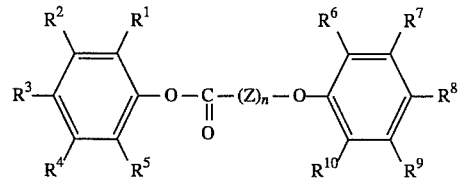

wherein:

each of $R^1$ to $R^{10}$ (same or different) represents hydrogen, an alkyl group, a cycloalkyl group, an aralkyl group, an aryl group, an alkoxy group, an aryloxy group, an acyl group, an ester group, an amide group, an amine group, an ether group, a carbonate group, which groups may be substituted, a halogen atom, a hydroxy group, a nitrile group;

Z represents —O—$R^{11}$—O—CO— wherein $R^{11}$ represents an alkyl group, a cycloalkyl group, an aralkyl group, an aryl group, which groups may be substituted (e.g. by halogen atoms);

n represents an integer from 0 to 4.

Preferably n represents 0. Preferred $R^1$–$R^{10}$ groups are: hydrogen, alkyl (e.g. methyl, t-butyl, 1-ethylhexyl and pentadecyl), cycloalkyl (e.g. cyclohexyl), aryl groups and aralkyl groups (e.g. 2-phenyl-2-propyl). In the case of substituted aryl groups preferably only one of $R^1$ to $R^5$ (preferably $R^3$) and only one of $R^6$ to $R^{10}$ (preferably $R^8$) does not represent hydrogen and preferably both of these substituents are the same.

When the substituents R1–$R^{10}$ represent long aliphatic chains a reduced sticking between the donor element and the receiving element during printing can be observed.

Preferred plasticizers according to the present invention are listed hereinafter.

I

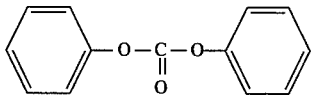

II

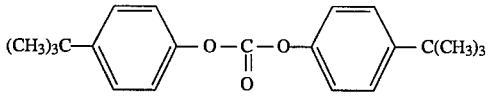

III

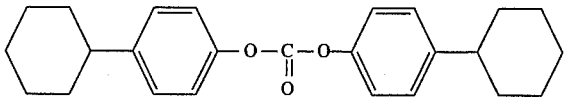

IV

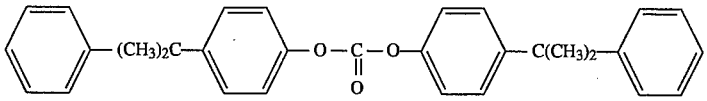

V

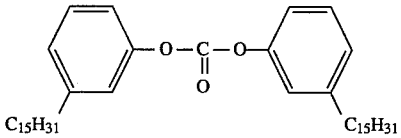

VI

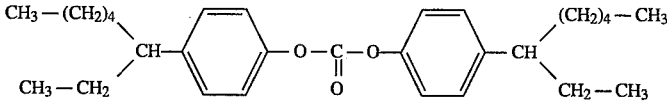

VII

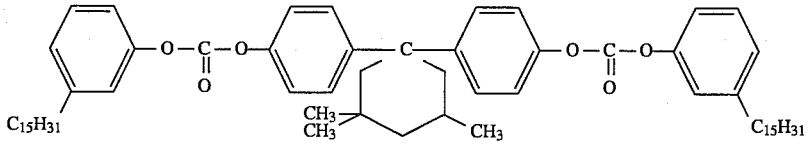

VIII

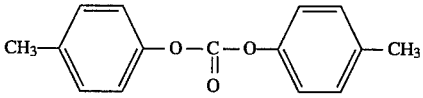

IX

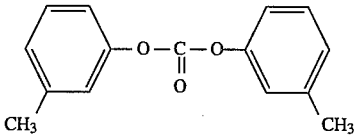

X

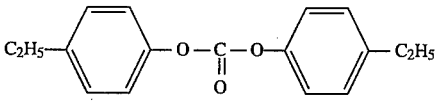

The di(hetero)aryl carbonate plasticizer according to the present invention may be present in the dye-image receiving layer in any amount which is effective for the intended purpose. In general, good results have been obtained when the plasticizer according to the present invention is present in an amount of from 1 to 50% based on the dye-image receiving layer binder.

The di(hetero)aryl carbonate plasticizers of the present invention can be combined with any other plasticizer known in the field, such as the plasticizers described in U.S. Pat. No. 4,871,715, JP 61/268483, JP 61/274990, JP 62/132676 and JP 02/194995; phenol derivatives (e.g. p-decylphenol, p-methoxyphenol, p-(2-phenylethoxy)phenol); hydroquinone derivatives (e.g. hydroquinone dichloromethylester).

The dye-image receiving layer may comprise as binder any of the conventional receiving layer binders such as, for example, a polycarbonate (e.g. a polycarbonate derived from 2,2-bis-(4-hydroxyphenyl)-propane or a polycarbonate derived from 1,1-bis-(4-hydroxyphenyl )-3,3,5-trimethylcyclohexane), a polyurethane, a polyester, polyvinylchloride, poly(styrene-cooacrylonitrile) or mixtures thereof. Also a cured binder composition can be used, for example, the product obtained by crosslinking of poly(vinylchloride-co-vinylacetate-co-vinylalcohol) with polyisocyanate.

The total amount of binder used in the dye receiving layer of the present invention is from 25 to 95 % by weight, preferably from 50 to 80% by weight.

The dye receiving element of the present invention can contain a release agent for improvement of the release property with respect to the donor element. As the release agent, solid waxes such as polyethylene wax, amide wax, and Teflon powder; fluorine based and phosphate ester based surfactants; and paraffin based, silicone based and fluorine based oils can be used. Silicone oils, preferably reactive silicone oils and silicone containing copolymers such as polysiloxane-polyether copolymers and blockcopolymers, are preferred (e.g. TEGOGLIDE supplied by Goldschmidt and SILWET supplied by Union Carbide).

For the purpose of improving the whiteness of the receiving layer to enhance sharpness of the transferred image and also imparting writability to the receiving surface as well as preventing retransfer of the transferred image, a white pigment can be added to the receiving layer. As white pigment, titanium oxide, zinc oxide, kaolin, clay, calcium carbonate, fine powdery silica, etc. can be employed, and these can be used as a mixture of two or more kinds as described above.

Also, for further enhancing the light resistance of the transferred image, one or two or more kinds of additives such as UV-ray absorbers, light stabilizers and antioxidants, can be added, if necessary. The amounts of these UV-ray absorbers and light stabilizers is preferably 0.05 to 10 parts by weight and 0.5 to 3 parts by weight, respectively, per 100 parts of the resin constituting the receiving layer.

A toplayer can be provided on top of the receiving layer to improve the release from the donor element after transfer is effected. Said toplayer generally comprises a release agent of the type described above, e.g. a polysiloxane-polyether copolymer.

As the support for the receiver sheet it is possible to use a transparant film or sheet of various plastics such as polyethylene terephthalate, polyolefin, polyvinyl chloride, polystyrene, polycarbonate, polyether sulfone, polyimide, cellulose ester or polyvinyl alcohol-co-acetal. Blue-colored polyethylene terephthalate film can also be used. The support may also be a reflective support such as paper e.g. top quality paper, art paper, cellulose fiber paper; baryta-coated paper; polyolefin-coated paper e.g. dual polyethylene-coated paper; synthetic paper e.g. polyolefin type, polystyrene type or white polyester type i.e. white-pigmented polyester.

Also, a laminated product by any desired combination of the above can be used. Typical examples of the laminates include a laminate of cellulose fiber paper and synthetic paper and a laminate of cellulose fiber paper and a plastic film or sheet. As further examples of the laminates, a plastic film can be used with synthetic paper instead of cellulose fiber paper. Further, a laminate of cellulose fiber paper, plastic film and synthetic paper can also be used.

In case plain paper is used as support for the dye-image receiving element a fill-up coating is preferably provided between the support and the receiving layer or a relatively thick dye receiving layer is used (at a coverage in the range of 10 to 20 g/m$^2$) in order to smooth away the fibrous texture of the paper and to obtain a dye receiving layer with a smooth surface. Preferred fill-up coatings are coatings comprising the polyesters described in European patent applications nos 90202760 and 90202759. An advantage of plain paper compared to polyethylene-coated paper is the fact that plain paper is cheaper and that the sharpness of the transferred image is improved (in the polyethylene coating lateral diffusion of the dye takes place).

The support sheet serves to support the dye receiving layer, and it is desirable that the support sheet has mechanical strength sufficient enough to handle the dye receiving sheet which is heated at the time of heat transfer recording. If the dye-receiving layer alone has the necessary mechanical strength, the support sheet may be omitted.

The dye-receiving layer of the present invention preferably has an overall thickness of from 0.5 to 50 μm, more preferably from 2.5 to 10 μm, when the dye-receiving layer is provided on a support sheet, or preferably from 3 to 120 μm when it is self-supporting i.e. a support sheet is omitted.

The image receiving layer may be a single layer, or two or more such layers may be provided on the support.

Also receiving layers may be formed on both surfaces of the support. In the case of a transparant support recto-verso printing on both receiving layers as described in EP 452566 then leads to an increase in density of the transferred image.

In case a toplayer is provided the thickness of such a toplayer is preferably 0.01 to 5 μm, particularly 0.05 to 2 μm.

The image receiving element of the present invention may also have one or more intermediate layers between the support and the image receiving layer. Depending on the material from which they are formed, the intermediate layers may function as cushioning layers, porous layers or dye diffusion preventing layers, or may fulfill two or more of these functions, and they may also serve the purpose of an adhesive, depending on the particular application.

The material constituting the intermediate layer may include, for example, an urethane resin, an acrylic resin, an ethylenic resin, a butadiene rubber, or an epoxy resin. The thickness of the intermediate layer is preferably from 1 to 20 μm.

Dye diffusion preventing layers are layers which prevent the dye from diffusing into the support (particularly if the support is polyethylene-coated paper). The binders used to form these layers may be water soluble or organic solvent soluble, but the use of water soluble binders is preferred, and especially gelatin is most desirable. Examples of other suitable binders for the dye diffusion preventing layer are polyacrylic acid, polyvinylpyrrolidone, polyvinylalcohol, poly(vinylchloride-covinylacetaat) and polyester.

Porous layers are layers which prevent the heat which is applied at the time of thermal transfer from diffusing from the image receiving layer to the support to ensure that the heat which has been applied is used efficiently.

Fine powders consisting of silica, clay, talc, diatomaceous earth, calcium carbonate, calcium sulfate, barium sulfate, aluminum silicate, synthetic zeolites, zinc oxide, lithophone, titanium oxide or alumina for example, can be included in the image receiving layers, cushioning layers, porous layers, diffusion preventing layers and adhesive layers, etc. constituting the thermal transfer image receiving element of the present invention.

Also, the image receiving element of the present invention can have antistatic treatment applied to the front or back surface thereof. Such antistatic treatment may be carried out by incorporating an antistatic agent in, for example, the image receiving layer which becomes the front surface or in an antistatic preventive layer applied to the image receiving surface. A similar treatment can also be effected to the back surface. By such treatment, mutual sliding between the image receiving sheets can be smoothly performed, and there is also the effect of preventing the attachment of dust on the image receiving sheet.

Furthermore, the image receiving sheet can have a lubricating layer provided on the back surface of the sheet support. The material for the lubricating layer may include methacrylate resins such as methyl methacrylate, etc. or corresponding acrylate resins, vinyl resins such as vinyl chloride-vinyl acetate copolymer.

The receiving element can have detection marks provided on one surface, preferably the back surface so that the receiving element can be accurately set at a desired position during transfer, whereby the image can be formed always at a correct desired position.

A dye-donor element for use according to thermal dye sublimation transfer in combination with the present receiving element usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

The dye layer of such a thermal dye sublimation transfer donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 μm, preferably 0.4 to 2.0 μm, and the ratio of dye to binder is between 9:1 and 1:3 by weight, preferably between 3:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or poly(styrene-acrylonitrile(-co-butadieen)) is used as binder for the dye layer.

Any dye can be used in such a dye layer provided it is easily transferable to the dye-image-receiving layer of the receiver sheet by the action of heat.

Typical and specific examples of dyes for use in thermal dye sublimation transfer have been described in, e.g., EP 453020, 91200791.1, EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, EP 400706, U.S. Pat. No. 4,743,582, U.S. Pat. No. 4,753,922, U.S. Pat. No. 4,753,923, U.S. Pat. No. 4,757,046, U.S. Pat. No. 4769360, U.S. Pat. No. 4,771,035, JP 84/78894, JP 84/78895, JP 84/78896, JP 84/227490, JP 84/227948, JP 85/27594, JP 85/30391 , JP 85/229787, JP 85/229789, JP 85/229790, JP 85/229791, JP 85/229792, JP 85/229793, JP 85/229795, JP 86/41596, JP 86/268493, JP 86/268494, JP 86/268495 and JP 86/284489.

The coating layer may also contain other additives, such as curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a polyethylene terephthalate support. In general, the support has a thickness of 2 to 30 μm. The support may also be coated with an adhesive or subbing layer, if desired.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. No. 4,567,113, U.S. Pat. No. 4,572,860, U.S. Pat. No. 4,717,711. Preferably the slipping layer comprises as binder a styrene-acrylonitrile copolymer or a styrene-acrylonitrile-butadiene copolymer or a mixture thereof or a cellulose ester and as lubricant in an amount of 0.1 to 10 % by weight of the binder (mixture) a polysiloxane-polyether copolymer or polytetrafluoroethylene or a mixture thereof.

The dye layer of the dye-donor element may also contain a releasing agent that aids in separating the dye-donor element from the dye-receiving element after transfer. The releasing agents can also be applied in a separate layer on at least part of the dye layer. For the releasing agent solid waxes, fluorine- or phosphate-containing surfactants and silicone oils are used. Suitable releasing agents are described in e.g. EP 133012, JP 85/19138, EP 227092.

The dye-receiving elements according to the invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In order to accomplish a perfect register when the process is performed for more than one color and in order to detect what color is existing at the printing portion of the donor element, detection marks are commonly provided on one surface of the donor element. Generally optically detectable marks are used that can be detected by a light source and a photo sensor; detection can be done by measuring the light transmitted through the detection mark or reflected from said mark. The marks being in the form of a light-absorbing or light-reflecting coating are formed in a preassigned position on the donor element by e.g. gravure printing. The detection marks can comprise an infrared absorbing compound such as carbon black. The detection mark can also comprise one of the image dyes that are used for the image formation, with the detection being in the visible range.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically adressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLE 1

A polyethylene terepthalate film of 175 μm provided with a conventional subbing layer was coated with a composition in methylethylketone for forming the receiving layer comprising in amounts (in g/m$^2$ ) as indicated in table 1 below poly(vinylchloride-co-vinylacetate-co-vinylalcohol) (90/4/6 wt %) (sold under the tradename VINYLITE VAGD by Union Carbide), diisocyanate (DESMODUR VL supplied by Bayer AG), hydroxy modified polydimethylsiloxane (TEGOMER H SI 2111 supplied by Goldschmidt) and plasticizer the nature and amount of which is indicated in table 1 below. After coating the layer was dried at 120° C. during 15 minutes.

A dye donor element was prepared as follows:

A solution comprising 5 wt % dye A, 3 wt % dye B, 2.5 wt % dye C, 6 wt % of poly(styrene-co-acrylonitrile) as binder and 2.5 wt % of decanediol as thermal solvent in methylethylketone as solvent was prepared. From this solution a layer having a wet thickness of 10 μm was coated on 6 μm thick polyethylene terephthalate film. The resulting layer was dried by evaporation of the solvent.

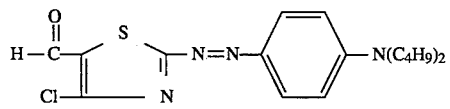

dye A

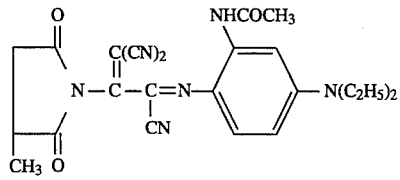

dye B

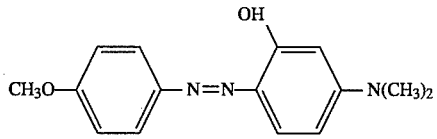

dye C

The back side of the polyethylene terephthalate film was provided with a slipping layer coated from a solution containing 13 wt % poly(styrene-co-acrylonitrile) binder and 1 wt % polysiloxane-polyether copolymer as lubricant.

The obtained dye receiving element was printed in combination with the dye-donor element in a Mitsubishi video printer type CP 100.

The receiver sheet was separated from the dye-donor element and the dye density of the transferred image in transmission was measured in the red, green and blue region by means of a Macbeth TD102 densitometer equipped with Wratten filters 92, 93 and 94.

The sharpness of the obtained dye image stored for 7 days at 60° C. and 90% relative humidity was visually evaluated.

The results are indicated in table 1 below.

TABLE 1

| Vinylite | Desmodur | Tegomer | plasticizer amount | plasticizer type | densities red | densities blue | densities green | sharpness |
|---|---|---|---|---|---|---|---|---|
| 5 | 0.75 | 0.2 | none | | 1.52 | 1.65 | 1.63 | very good |
| 4.75 | 0.75 | 0.2 | 0.25 | I | 1.70 | 1.85 | 1.87 | very good |
| 4.5 | 0.75 | 0.2 | 0.5 | I | 1.67 | 1.77 | 1.83 | very good |
| 4 | 0.75 | 0.2 | 1 | I | 1.63 | 1.73 | 1.76 | very good |
| 4.75 | 0.75 | 0.2 | 0.25 | II | 1.50 | 1.63 | 1.59 | very good |
| 4.5 | 0.75 | 0.2 | 0.5 | II | 1.62 | 1.75 | 1.76 | very good |
| 4 | 0.75 | 0.2 | 1 | II | 1.65 | 1.83 | 1.83 | very good |
| 4.75 | 0.75 | 0.2 | 0.25 | III | 1.61 | 1.71 | 1.73 | very good |
| 4.5 | 0.75 | 0.2 | 0.5 | III | 1.64 | 1.77 | 1.79 | very good |
| 4 | 0.75 | 0.2 | 1 | III | 1.68 | 1.83 | 1.87 | good |
| 4.75 | 0.75 | 0.2 | 0.25 | IV | 1.55 | 1.65 | 1.65 | very good |
| 4.5 | 0.75 | 0.2 | 0.5 | IV | 1.55 | 1.71 | 1.67 | very good |
| 4.75 | 0.75 | 0.2 | 0.25 | VI | 1.55 | 1.69 | 1.67 | very good |
| 4.5 | 0.75 | 0.2 | 0.5 | VI | 1.55 | 1.71 | 1.70 | very good |

EXAMPLE 2

A receiving element was prepared as follows:

A 15 % solution in methylethylketone for forming the receiving layer comprising a polycarbonate binder and a plasticizer, the nature and amount (in g/m$^2$) of which are indicated below in table 2 was coated (wet layer thickness 20 μm) on paper provided on both sides with a polyethylene coating and on one side thereof (the receiving layer side) supplementary with a gelatine coating. After coating the layers were dried at 70° C. for 30 minutes. On top of the receiving layer a layer was coated (wet layer thickness 24 μm) from a solution comprising 0.5% Tegoglide 410 releasing agent (supplied by Goldschmidt) in ethanol and subsequently dried at 70° C.

The obtained dye receiving element was printed in combination with a commercially available donor element type CK-100 S supplied by Mitsubishi in a Mitsubishi video printer type CP 100E.

The receiver sheet was separated from the dye-donor element and the dye density of the transferred image was measured in reflection in the blue region by means of a Macbeth TD102 densitometer.

The results are indicated in table 2 below.

TABLE 2

| polycarbonate amount | polycarbonate type | plasticizer amount | plasticizer type | density |
|---|---|---|---|---|
| 3 | BPA | none | | 0.40 |
| 2 | BPA | 1 | III | 1.63 |
| 2 | BPA | 1 | VI | 1.47 |
| 2 | BPA | 1 | VII | 0.61 |
| 3 | HIP | none | | 0.15 |
| 2 | HIP | 1 | III | 1.06 |
| (*) 2 | HIP | 1 | VI | 0.90 |
| 2 | HIP | 1 | VII | 1.10 |

BPA = polycarbonate derived from 2,2-bis-(4-hydroxyphenyl)-propane
HIP = polycarbonate derived from 1,1-bis-(4-hydroxyphenyl)-3,3,5-trimethylcyclohexane
(*) = is not provided with a toplayer

We claim:

1. Dye-image receiving element for use according to thermal dye sublimation transfer comprising a support having thereon (i) a dye-image receiving layer comprising, a plasticizer and a polymeric binder and (ii) a releasing agent, said plasticizer being a diaryl carbonate having not more than four recurring units between the two aryl moieties, and corresponds to the following formula

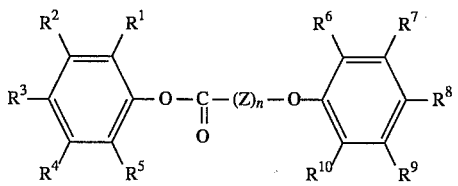

wherein:

each of $R^1$ to $R^{10}$ (same or different) represents hydrogen, an alkyl group, a cycloalkyl group, an aralkyl group, an aryl group, an alkoxy group, an aryloxy group, an acyl group, an ester group, an amide group, an amine group, an ether group, a carbonate group, a halogen atom, a hydroxy group, or a nitrile group;

Z represents —O—$R^{11}$—O—CO— wherein $R^{11}$ represents an alkyl group, a cycloalkyl group, an aralkyl group, or an aryl group, n represents an integer from 0 to 4.

2. Dye-image receiving element according to claim 1, wherein n equals 0.

3. Dye-image receiving element according to claim 1, wherein $R^3$ and $R^8$ both represent an alkyl group or a cycloalkyl group or an aryl group or an aralkyl group and wherein $R^1$, $R^2$, $R^4$ to $R^7$, $R^9$ and $R^{10}$ represent hydrogen

4. Dye-image receiving element according to claim 1, wherein the amount of diaryl carbonate plasticizer in the receiving layer is between 1 and 50 % by weight of the dye-image receiving layer binder.

5. Dye-image receiving element according to claim 1, wherein the binder is selected from the group consisting of polycarbonate, a copolymer of vinylchloride and cured compositions obtained by crosslinking poly(vinylchloride-co-vinylacetate-vinylalcohol ) with polyisocyanate.

* * * * *